United States Patent [19]

Skiera

[11] 4,183,297

[45] Jan. 15, 1980

[54] ROTARY ASSEMBLY FOR TWO-SIDED OFFSET PRINTING

[75] Inventor: Heinz Skiera, Leipzig, German Democratic Rep.

[73] Assignee: VEB Polygraph Leipzig Kombinat für Polygraphische Maschinen und Ausrüstungen, Leipzig, German Democratic Rep.

[21] Appl. No.: 794,567

[22] Filed: May 6, 1977

[30] Foreign Application Priority Data

May 13, 1976 [DD] German Democratic Rep. ... 192823

[51] Int. Cl.[2] ..... B41F 7/02

[52] U.S. Cl. ..... 101/218; 101/220

[58] Field of Search ..... 101/220–225, 101/229, 231, 177–182, 184–185, 247, 216–218, 212, 153

[56] References Cited

U.S. PATENT DOCUMENTS

| | | | |
|---|---|---|---|
| 2,090,939 | 8/1937 | Crafts et al. | 101/153 |
| 2,362,735 | 11/1914 | Heiss | 101/153 |
| 2,460,504 | 2/1949 | Huebner | 101/216 X |
| 3,323,452 | 6/1967 | Pasquinelli | 101/218 |
| 3,452,672 | 7/1969 | Bolza-Schunemann et al. | 101/229 X |
| 3,470,816 | 10/1969 | Piecha et al. | 101/216 |
| 3,527,165 | 9/1970 | Horless | 101/143 |
| 3,616,751 | 11/1971 | Mohry | 101/220 |
| 3,633,503 | 1/1972 | Tafel | 101/218 |

*Primary Examiner*—Edward M. Coven
*Attorney, Agent, or Firm*—Michael J. Striker

[57] ABSTRACT

A pair of parallel blanket rollers have their ends received in respective eccentrics themselves received in respective spaced-apart holes in a support frame. A pair of plate cylinders each tangentially contacting a respective blanket cylinder are similarly received in respective eccentrics also received in respective holes in the machine support. Each of the holes receiving an eccentric for a respective cylinder is of greater diameter than the respective cylinder so that the cylinders can be mounted in the machine frame by slipping them axially through these holes. A web to be printed is passed between the two blanket cylinders for simultaneous printing on both sides. The plate cylinder to one side of the web being printed and the blanket cylinder to the opposite side lie in one plane and the other two cylinders lie in another plane parallel to but spaced horizontally from the first-mentioned plane. Rotation of the eccentrics, at least the inner ones of which may be formed of two parts, allows radial adjustment of the various cylinders relative to each other.

12 Claims, 3 Drawing Figures

ROTARY ASSEMBLY FOR TWO-SIDED OFFSET PRINTING

BACKGROUND OF THE INVENTION

The present invention relates to a printing assembly. More particularly this invention concerns a rotary press for offset printing on both sides of a web or sheet.

It is known to pass a web or sheet between a pair of blanket cylinders each tangentially engaging a respective plate cylinder so as simultaneously to print on both sides of the sheet or web. Moistening and/or inking rollers are associated in turn with each of the plate cylinders.

It is essential in such an arrangement that the various cylinders be exactly aligned with each other. To this end they are always mounted in a frame constituted by a pair of walls or supports. Each cylinder has two end pins which are each journalled in a respective one of the two spaced-apart supports. Adjustment means of some type must be provided on each of the supports so as to displace the journal axes of the cylinders for a proper alignment of the cylinders with one another.

Typically the cylinders are mounted between the two supports by first inserting the pin or peg at one end of each of the cylinders through one of the supports and pushing it therethrough far enough so that the other end peg can be aligned with the appropriate journal in the other support whereupon the cylinder is pulled back and also inserted in the other support.

Such an arrangement, therefore, requires that at least one of the journal pegs on each of the cylinders be relatively long so as to permit the axial shifting of the cylinder for mounting between the supports. This increases the fabrication cost of the cylinder. Another disadvantage of this arrangement is that it is therefore necessary that the cylinder be spaced at least at one of its ends by a distance at least equal to the depth with which the other end is inserted in the respective journal. Thus the cylinders are supported relatively far from their centers, thereby increasing the possibility of bending of these cylinders while at the same time making control of them and adjustment substantially more difficult.

It has been suggested to overcome this difficulty in part by means of complicated mounting arrangements which often are little better than the systems they replace, and which greatly increase the cost of the printing assembly. Another suggestion has been to increase the roller diameters so that, even though they are parted relatively widely, the rollers are unlikely to bend. This increased size once again increases the bulk and cost of the printing assembly.

It is also known, as for instance disclosed in British Pat. No. 843,899, to mount the two plate cylinders one above the other in a common vertical plane and to provide the respective blanket cylinders between them with the axes of these blanket cylinders flanking the plane of the axes of the plate cylinders. Such an arrangement requires relatively complex and expensive adjustment gear to allow the various cylinders to be exactly aligned with one another. It is essential in a printing operation that each of the blanket cylinders engage its respective plate cylinder along the full length thereof with enough force to transfer the ink, but not so strongly as to damage the plate cylinder. Furthermore each of the blanket cylinders must engage the paper with sufficient force and evenness to transfer the ink to the paper, but not so strongly as to damage the paper or blur the image.

SUMMARY OF THE INVENTION

It is therefore an object of the present invention to provide an improved printing assembly of the above-described general type.

Another object of this invention is to provide a printing assembly wherein the various cylinders can be received between a pair of supports which are spaced apart by a distance only slightly greater than the cylinder length.

A further object is to provide a printing assembly wherein adjustment of the positions of the cylinders is a relatively simple matter, and is effected by means of an inexpensive and simple structure.

These objects are attained according to the present invention in a printing assembly wherein the support is formed with a front inner hole, a back inner hole adjacent the front inner hole, a front outer hole whose axis defines with the back inner hole axis a first plane, and a back outer hole whose axis defines with the front inner hole axis a second plane substantially parallel to and spaced from the first plane. Respective front and back inner and outer eccentrics are rotatable in the front and back inner and outer holes about the respective hole axes and define respective front and back inner and outer journal axes eccentrically offset from the respective hole axes. Respective front and back inner and outer cylinders are in turn journalled in the eccentrics about the respective journal axes, with each outer cylinder bearing on the respective inner cylinder and the two outer cylinders flanking the inner cylinders.

In accordance with this invention the inner cylinders are blanket cylinders and the outer cylinders are plate cylinders which are associated with the necessary moistening and/or inking rollers. The terms "front" and "back" are here used only in the relative sense, as one of the inner cylinders prints on one side or the front of a sheet or web and the other inner cylinder prints on the other side or back of the same sheet or web. Thus the two inner or blanket cylinders define a nip through which the workpiece to be printed is fed.

According to further features of this invention each of the holes is throughgoing and is of a diameter slightly larger than that of the respective cylinder. Thus it is possible to assemble the press according to this invention merely by sliding each cylinder with its respective eccentric in through the respective hole. Thus the supports at the ends of the cylinders need merely be spaced slightly from these ends, as the cylinders are fed directly axially into the machine through the holes in one of the supports. The zig-zag staggering of the hole axes allows these holes to have diameters which are larger than those of the respective cylinders, while still leaving webs between the adjacent holes for good structural support of the eccentrics carrying the cylinders.

According to yet another feature of this invention each of the inner hole axes defines an inner plane with the other inner hole axis and an outer plane with the respective outer hole axis. Each of these inner planes lies at an obtuse angle to the respective outer plane. This obtuse angle is between 100° and 160°, 130° being found to be particularly advantageous.

In accordance with yet another feature of this invention each of the outer journal axes lies generally on the respective outer plane between the respective outer hole axis and the respective inner hole axis. Furthermore each of the inner hole axes lies generally on the respective inner plane between the two inner hole axes.

For finest possible adjustment of the position of the blanket rollers each of the inner eccentrics comprises an inner hole eccentric having an outer periphery centered on the respective hole axis and an inner periphery defining an adjustment axis eccentrically offset both from the respective journal axis and the hole axis. Each of these inner eccentrics further includes an inner journal eccentric having an outer periphery centered on the respective adjustment axis and an inner periphery defining the respective journal axis. Each of the adjustment axes in turn lies between the respective journal axis and the respective hole axis. Thus rotation of the inner journal eccentric mainly adjusts the respective blanket cylinder relative to its plate cylinder without displacing this blanket cylinder much relative to the other blanket cylinder. When, however, the hole eccentric is rotated the respective blanket cylinder is displaced hardly at all relative to the respective plate cylinder, but is moved relative to the other blanket cylinder.

Furthermore the eccentric offsets of the hole and journal eccentrics allow the respective inner holes to be spaced relatively further apart than would normally be possible. Also the hole eccentric of the back inner cylinder serves also for fine adjustment of the axial spacing between the blanket cylinders and the drive pinion that rotates them.

In accordance with yet another feature of this invention each of the outer eccentrics is also provided with means for rotating it in its respective hole for adjustment of the plate cylinders.

The novel features which are considered as characteristic for the invention are set forth in particular in the appended claims. The invention itself, however, both as to its construction and its method of operation, together with additional objects and advantages thereof, will be best understood from the following description of a specific embodiments when read in connection with the accompanying drawings.

DESCRIPTION OF A PREFERRED EMBODIMENT

Figure 1:
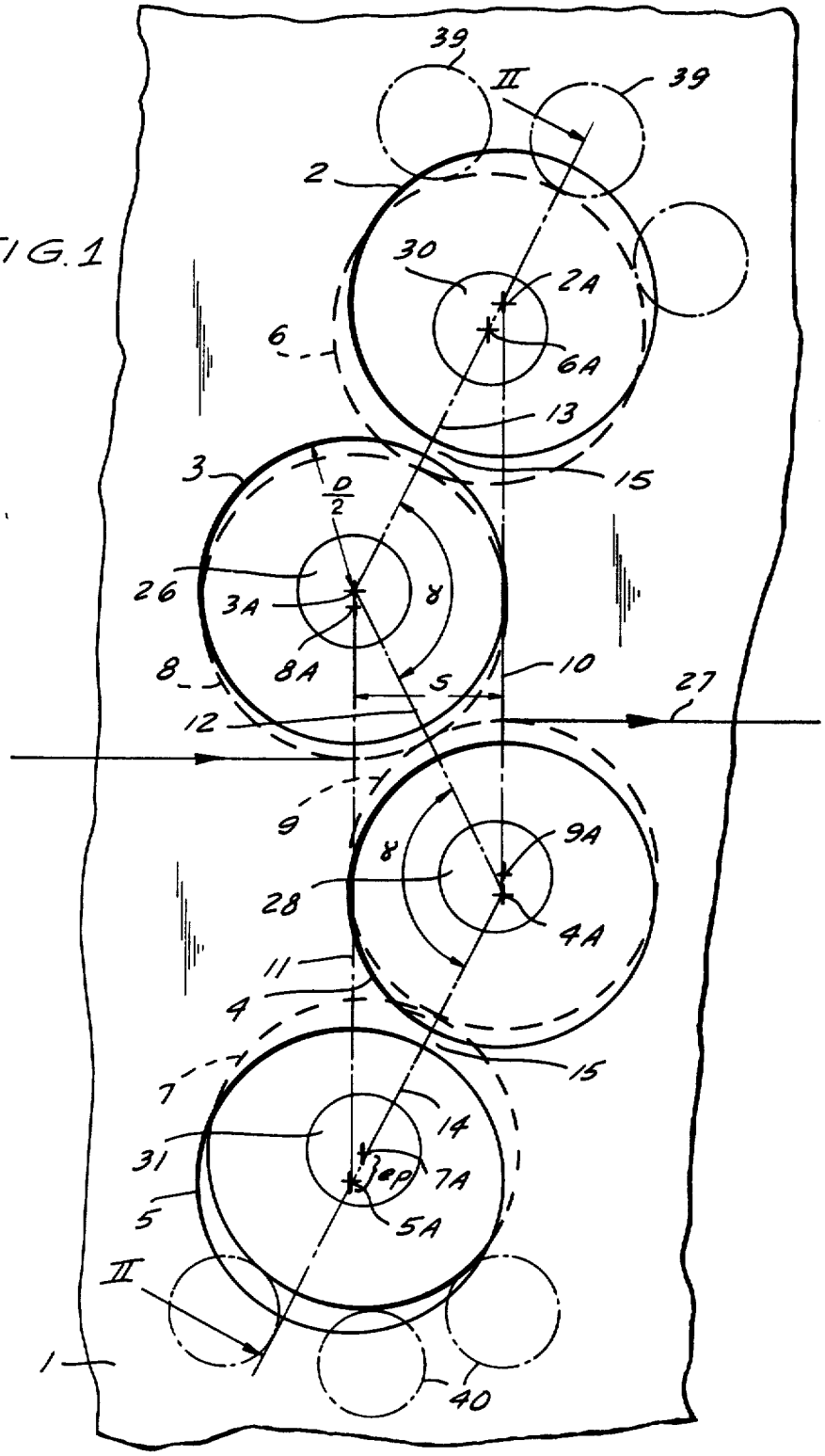
FIG. 1 is an end view of the printing assembly according to this invention.
Figure 2:
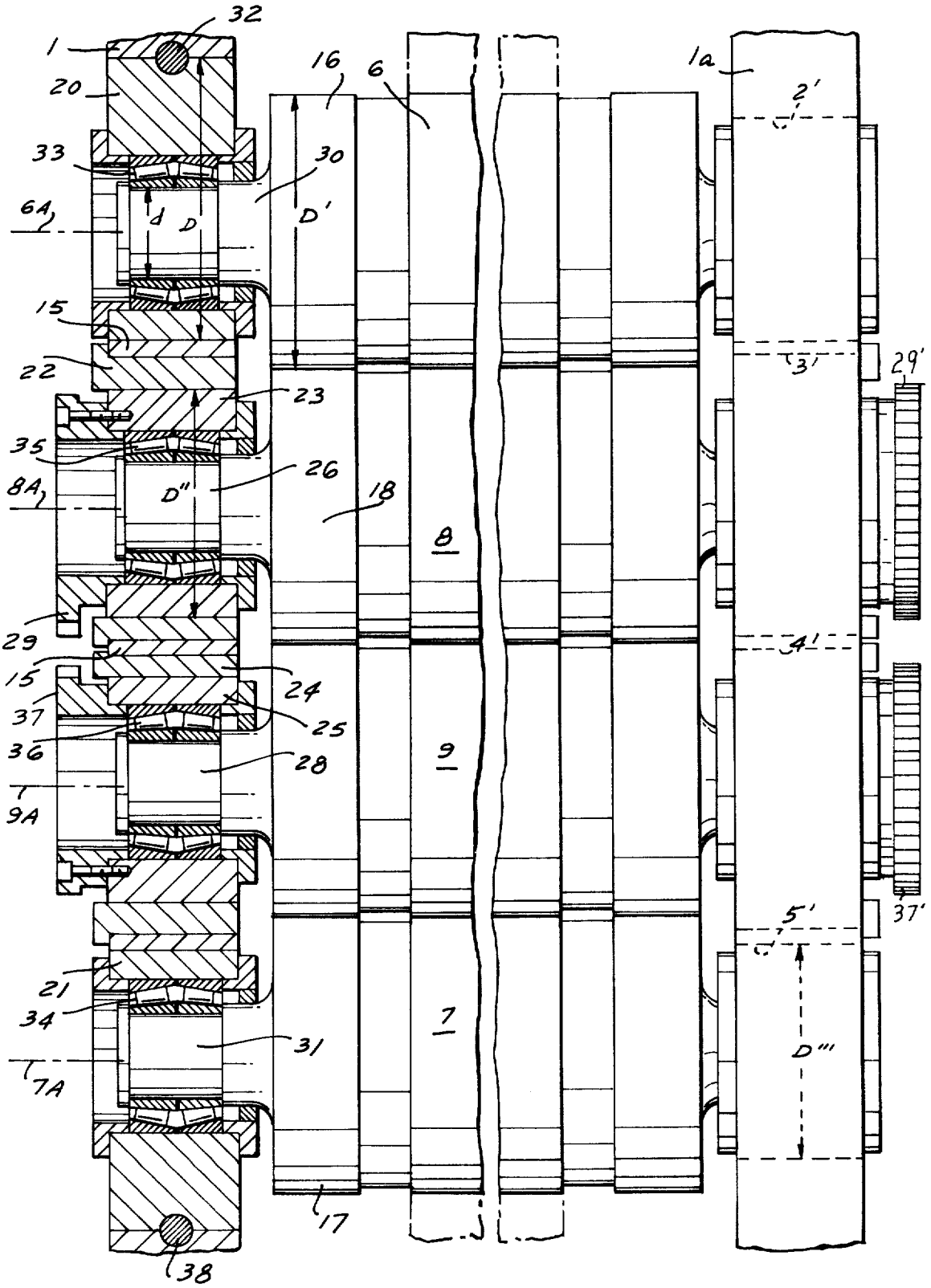
FIG. 2 is a section taken along zig-zag line II—II of FIG. 1.

As shown in FIGS. 1 and 2 a printing assembly according to this invention has a first machine frame or support wall 1 and spaced horizontally therefrom a second machine support wall 1*a*. The wall 1 is formed with four cylindrical holes 2–5 having respective axes 2A–5A and the wall 1*a* is formed with respective holes 2'–5'. The holes 2–5 are all of like diameter D and the holes 2'–5' are all of like diameter D''' substantially smaller than the diameter D.

The axes 2A and 4A of the holes 2 and 4 are aligned directly above each other in a common vertical plane 10. Similarly the axes 3A and 5A are arrayed directly above each other in a common plane 11 which is parallel to and spaced from the plane 10 by a distance S. The two inner axes 3A and 4A define a plane 12 lying at an angle of 25° to the planes 10 and 11. In addition the axes 2A and 3A define a plane 13 and the axes 4A and 5A a plane 14 which extend at angles $\alpha$ of 130° to the inner plane 12. The diameters D of the holes 2–5 are equal substantially to the spacing S between the planes 10 and 11 so that webs 15 are left in the support 1 between each of the holes 2–5 and the adjacent hole.

Plate or outer cylinders 6 and 7 are carried in the outer holes 2 and 5 and blanket or inner cylinders 8 and 9 are carried in the holes 3 and 4. These cylinders 6–9 have diameters D' smaller than the diameters D of the holes 2–5 but greater than the diameters D''' of the holes 2'–5'. Furthermore each of these rollers 6–9 has a respective end ring 16–19 of the same diameter D'. The rollers 6, 7, 8 and 9 are further formed with respective pegs 30, 31, 26 and 28, defining cylinder or journal axes 6A, 7A, 8A and 9A and received in respective bearings 33, 34, 35 and 36.

The outer or plate cylinders 6 and 7 have their respective bearings 33 and 34 received inside respective eccentric rings 20 and 21 having outer peripheries centered on the respective hole axes 2A and 5A and inner peripheries centered on the respective journal axes 6A and 7A. The axes 6A and 7A are offset on the respective planes 13 and 14 from the respective hole axes 2A and 5A by a distance $e_p$ equal here approximately to one-third of the diameter D. Means in the form of a pair of worm screws 32 and 38 (FIG. 2) are provided for rotating the respective eccentric rings 20 and 21 in the respective bores 2 and 5 so as to displace the axes 6A and 7A and, thereby, diagonally adjust the plate cylinders 6 and 7.

Figure 3:
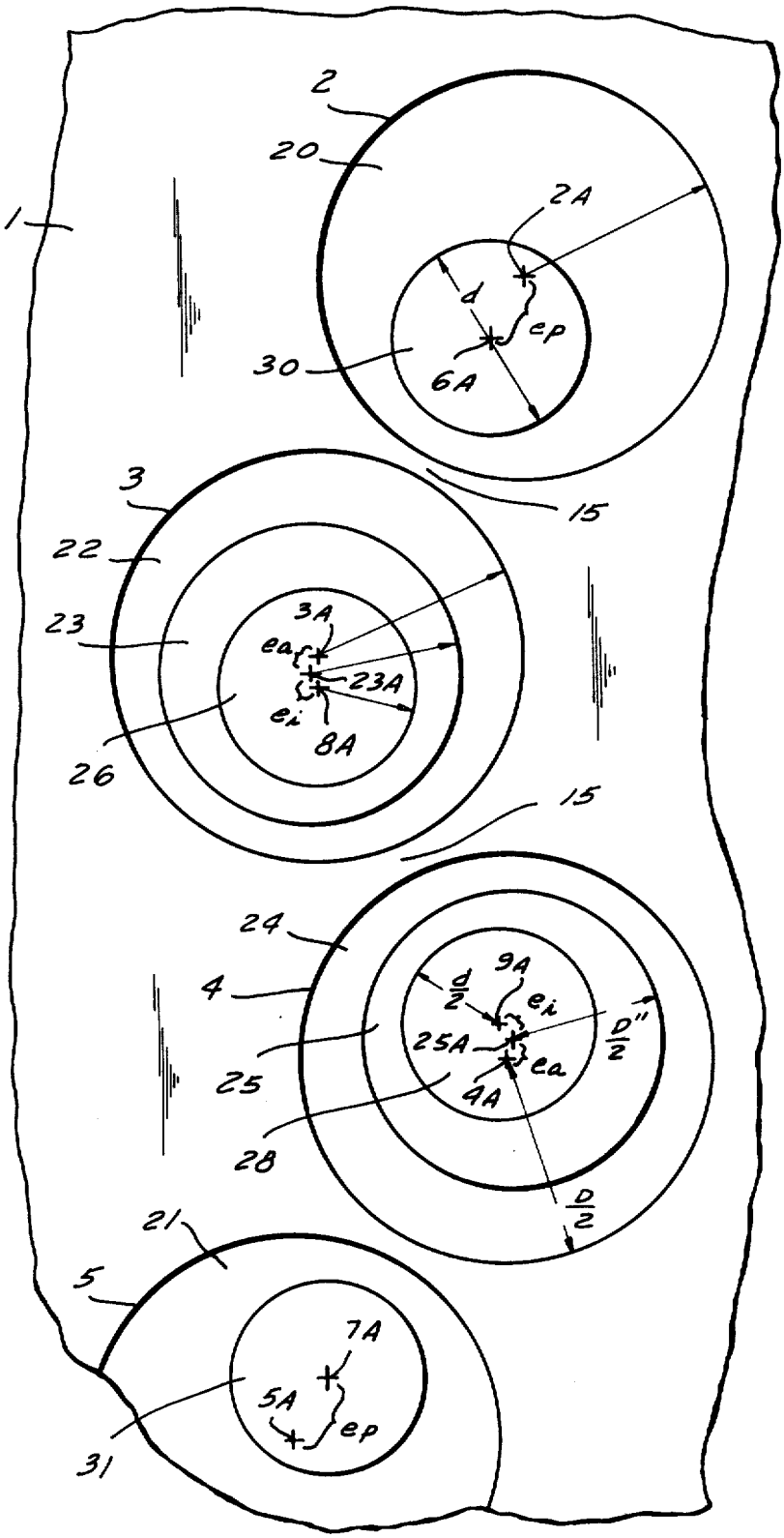
FIG. 3 is a large-scale view similar to FIG. 1 illustrating further details of this invention.

The pegs 26 and 28 of the blanket rollers 8 and 9 have diameters d identical to the diameters of the pegs 30 and 31 and their bearings 35 and 36 are received inside journal eccentrics 23 and 25 in turn received inside hole eccentrics 22 and 24. As shown in FIG. 3 the hole eccentrics 22 and 24 have outer peripheries centered on the respective axes 3A and 4A and inner peripheries of diameters D'' defining adjustment axes 23A and 25A for the journal eccentrics 23 and 25. These journal eccentrics 23 and 25 therefore have outer peripheries centered on the respective axes 23A and 25A and inner peripheries defining and centered on the journal axes 8A and 9A. The diameters D'' are intermediate the diameters d and the diameters D'''.

As further shown in FIG. 3 each of the journal axes 8A and 9A is offset by a spacing $e_i$ from the respective adjustment axis 23A and 25A toward the other inner hole axis. In addition each of the hole axes 3A and 4A is offset by a spacing $e_a$ toward the respective outer hole axis 6A and 5A from the respective adjustment axis 23A and 25A.

Fixed to both of the journal eccentric rings 23 and 25 are respective gears 29 and 37 which do not mesh with each other so that the respective adjustment arrangements can be independently operated. With the eccentric axes 23A and 25A arranged as shown rotation of the inner journal eccentrics 23 and 25 will hardly displace the two cylinders 8 and 9 relative to each other, but only relative to their respective plate cylinders 6 and 7.

In use the plate cylinders 6 and 7 are contacted by moistening and inking rollers 39 and 40, respectively. A paper web 27 whose upper front side and lower back side is to be printed is fed between the nip defined between the two cylinders 8 and 9 where they tangentially contact each other on the plane 12. In this manner both sides are simultaneously printed as the web 27 is advanced through the printing assembly.

It will be understood that each of the elements described above, or two or more together, may also find a useful application in other types of machines differing from the types described above.

While the invention has been illustrated and described as embodied in a printing assembly, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A printing assembly comprising a plurality of cylinders each having a mounting portion; a support; and means for adjacently mounting said cylinders on said support, including means bounding a plurality of adjacent cylindrical holes in said support which includes a web between and separating the adjacent holes, and a plurality of eccentrics each turnably received in one of said holes and eccentrically accommodating said mounting portion of one of said cylinders, each of said holes having a diameter exceeding that of the associated cylinder to permit the latter to pass therethrough for assembly with and disassembly from said support.

2. The assembly defined in claim 1, wherein said plurality of holes includes a front and a rear set of holes each including an inner hole adjacent, and an outer hole remote from, the inner hole of the other set, said holes of said sets having respective front and rear, inner and outer, hole axes; and wherein said front inner and rear outer axes, and said rear inner and front outer axes, define respective spaced and substantially parallel planes.

3. The assembly defined in claim 2, wherein said plurality of cylinders includes plate cylinders mounted in said outer holes and blanket cylinders mounted in said inner holes.

4. The assembly defined in claim 3, wherein said front and rear inner axes define an inner plane with each other; and wherein said outer and inner axes of each of said sets define an outer plane with each other which encloses an obtuse angle with said inner plane.

5. The assembly defined in claim 4, wherein said obtuse angle is between 100° and 160°.

6. The assembly defined in claim 5, wherein said angle is substantially 130°.

7. The assembly defined in claim 3, wherein said eccentrics so mount said mounting portions of the respective cylinders in the respective holes for rotation about respective front and rear, inner and outer, rotation axes that, when said cylinders assume operative positions with respect to one another, each of said outer journal axes lies between said outer and inner hole axes of the same set and each of said inner journal axes lies between said inner hole axes of said sets.

8. The assembly defined in claim 3, wherein said plurality of eccentrics includes respective inner and outer eccentrics which respectively mount said mounting portions of the respective cylinders in the respective holes for rotation about respective rotation axes; and wherein at least each of said inner eccentrics includes a hole eccentric coaxially received in the respective hole and defining a respective adjustment axis offset from the respective hole and rotation axes, and a journal eccentric journalled in the respective hole eccentric about the respective adjustment axis.

9. The assembly defined in claim 8, wherein each of said adjustment axes lies between the respective hole and rotation axes when said cylinders assume operative positions with respect to one another.

10. The assembly defined in claim 1, wherein each of said eccentrics is annular and has an outer periphery coaxially received in the respective hole and an inner periphery coaxially accommodating said mounting portion eccentrically to said outer periphery.

11. The assembly defined in claim 1, wherein said cylinders have substantially the same diameters; and wherein said holes also have substantially the same diameters exceeding those of said cylinders.

12. The assembly defined in claim 1; and further comprising an additional support having a plurality of additional holes therein which are smaller in diameter than said cylinders; and wherein each of said cylinders has an additional mounting portion which is turnably received in the respective additional hole.

* * * * *